US012599242B2

(12) United States Patent
Tejeda

(10) Patent No.: US 12,599,242 B2
(45) Date of Patent: Apr. 14, 2026

(54) RECUMBENT SLING HEADREST/LEG REST SUSPENSION SYSTEM

(71) Applicant: Evelyn Tejeda, Palm Beach Gardens, FL (US)

(72) Inventor: Evelyn Tejeda, Palm Beach Gardens, FL (US)

( * ) Notice: Subject to any disclaimer, the term of this patent is extended or adjusted under 35 U.S.C. 154(b) by 177 days.

(21) Appl. No.: 18/174,606

(22) Filed: Feb. 25, 2023

(65) Prior Publication Data

US 2024/0285083 A1 Aug. 29, 2024

(51) Int. Cl.
*A47C 16/00* (2006.01)
*A47G 9/10* (2006.01)

(52) U.S. Cl.
CPC ..... *A47C 16/00* (2013.01); *A47G 9/1009* (2013.01)

(58) Field of Classification Search
CPC ..... A47C 16/00; A47C 20/026; A47C 20/027; A47C 3/0255; A47C 7/383; A47C 5/06; A47C 31/023; A47C 7/282; A47C 4/02; A47G 9/1009; A47G 9/10; A47G 9/1054; A47G 9/1063; A47G 9/1081; A47G 9/1027; A47G 2009/003; A61G 2200/32; A61G 7/072; A61G 7/1019; A61G 7/1032; A61G 7/1015; A61G 7/1046; A61G 7/1055; A61G 5/12; A61G 7/001; B60N 2/812; B60N 2/809; B60N 2/42727; A45F 3/22; A45F 3/24
USPC ..... 5/643, 636; 297/440.11, 452.13, 16.2, 297/397, 403
See application file for complete search history.

(56) References Cited

U.S. PATENT DOCUMENTS 4,351,524 A * 9/1982 Gomes ..... A47C 3/0255 248/188
5,337,429 A * 8/1994 Tucker ..... A47G 9/1009 5/636
11,878,210 B1 * 1/2024 Torres ..... A63B 21/4005
2006/0174896 A1 * 8/2006 Dawes ..... A47C 19/022 128/845

OTHER PUBLICATIONS

"Rail." Merriam-Webster, Merriam-Webster, www.merriam-webster.com/dictionary/rail.*

* cited by examiner

*Primary Examiner* — Madison Emanski

(57) ABSTRACT

A recumbent headrest suspension system (10) comprises a pair of frames (13) that suspend a bridge-like fabric platform (8) adjustable for height, droop, and angle. The system functions as a sleep pillow alternative that allows a user to customize support to meet anatomical needs and comfort, distributing weight-bearing forces and minimizing restlessness by shifting pressure points. In one embodiment (FIG. 2A), the suspension system includes a U-shaped base or platform (5, 7*b*/7*a*) adapted to be placed beneath a mattress or bed, supporting a vertical frame member (4) connected to a horizontal frame member (3). The horizontal frame member includes a central roller (1) that suspends the fabric platform (8) and enables rotational adjustment, while user-activated control elements adjust platform tension or droop, the tilt of the horizontal frame member (3), and the height of the vertical frame member (4).

5 Claims, 4 Drawing Sheets

RECUMBENT SLING HEADREST/LEG REST SUSPENSION SYSTEM

REFERENCE TO RELATED APPLICATIONS

This application claims priority to U.S. Provisional Patent Application No. 63/268,471 filed on Feb. 24, 2022 and references U.S. Nonprovisional Utility patent application Ser. No. 17/559,827 filed on Dec. 22, 2021.

FIELD

The present invention relates generally to headrests and pillows, and, more specifically, to a recumbent headrest or leg-rest suspension system having a fabric sling platform and a frame that may be adjustable or fixed.

BACKGROUND

Beds and pillows are well known in the art. Their early existence in the U.S. Patent and Trademark Office is evidenced by their inclusion in Class 5 of the old U.S. Patent Classification that includes devices ordinarily known as beds, examining tables, operating tables, hammocks, cradles, cribs, cots, camp beds, ground mats, sleeping bags, and bed accessories, such as mattresses, pillows, surgical supports, and bed clothing.

Bed pillows have evolved into many forms, and it has been shown that the best position for an individual's head and neck is a pillow that supports the curve of the neck, such that when a user is sleeping on their back, their head and neck reflect the same good posture as when standing. However, many attempts to encourage proper head and neck positioning when sleeping restrict him/her from sleeping on his/her side or stomach. Pillows are also used to support the extremities: for example, when sleeping supine (face up), elevating the lower legs a few inches with support under the knees helps to relieve stress on the lower back. When the individual is sleeping on his/her side, elevating the upper leg also serves to decrease joint stress, especially on the lower back, by promoting a more neutral postural alignment.

U.S. Pat. No. 2,581,802 to Lyons discloses a sling headrest that generally comprises a frame and a fabric or flexible material slung between the elevated, longitudinally extending frame members as a sling for a user's head. The frame includes a pair of the base members extending from a fore-end of the frame and a connecting lateral crossmember. Vertical fore-frame members are 2 connected to the opposing longitudinal base members. Each pair of vertical fore-frame members bend or rotate as much as 90° from the vertical plane established by the vertical fore-frame members.

U.S. Pat. No. 6,581,226 to Brustein discloses an open frame pillow and a pillow support system. The pillow support system generally comprises a frame and includes an open pillow slipcover suspended vertically above the mattress. The frame includes opposing vertical fore-frame members, opposing longitudinally extending base frame members attached at their fore-end to the vertical members, and upper, longitudinally extending opposing frame members. These frame members do not move with respect to each other.

Chinese published patent disclosure CN 213721190 to Du discloses a collapsible, adjustable pillow frame that is arranged to hold a headrest slung on the elevated longitudinally extending frame members. The pillow frame includes opposing lateral crossmembers, opposing longitudinally extending lower members, opposing vertically extending fore-frame members, and opposing longitudinally extending upper frame members. Each of these members include slots that are arranged to accept and/or connect the frame members to adjacent crossmembers or to connect a member to a connector joint. The lower, cross and upper frame members appear to have a singular slot arranged to connect the members to a respective connector joint or and adjacent member. The upper connecting joints appear to have multiple slots at 90° angles with respect to each other allowing the upper connectors and the upper longitudinal frame members to be rotated 90° with respect to the vertical fore-frame members. A sling is arranged to provide a headrest support between the upper, longitudinally extending frame members.

One problem with prior art systems is that they are normally not adjustable to accommodate different sized individuals needing different height settings and levels of support during sleep repositioning. Thus, there is a need for a pillow alternative that is easily adjustable and better supports proper curvature of the spine while lying down in different positions (e.g., supine/side lying), in turn, decreasing mechanical stress on the spine and other body parts.

SUMMARY

The invention provides a recumbent headrest or leg-rest suspension system that offers a pillow alternative which overcomes the herein fore-mentioned disadvantages of the heretofore-known devices and methods of this general type.

In general, the recumbent head or leg rest support system consists of a pair of frames that together suspends a sling-like fabric platform. The sling-like fabric platform is affixed at both ends, bilaterally, to the suspension system's rotatable elements which serve to increase or decrease the fabric platform's tension or laxity. The headrest suspension system functions to support the head when the user is in the recumbent positions of supine (lying on one's back, face up), lying on his or her side, or prone (belly down). It allows the user to adjust the height and level of support in a controlled manner to meet their anatomical, cervical spine alignment needs. When the head is supported with the cervical spine in a more neutral anatomical alignment, there is decreased stress on the surrounding ligaments and vertebral discs, in turn, promoting relaxation of the local postural muscles and minimizing restlessness. Similarly, the leg-rest suspension system functions to support the lower extremities. When the leg or legs are supported in the appropriate elevated position, this serves to decrease stress on the joints of the lower back, pelvis, and legs—in turn, decreasing the risk for skeletal deformities.

Unlike standard bed pillows, the head- or leg-rest system of the present invention offers adjustability for height of support, surface area covered/weight bearing distribution and shifting of pressure point.

The headrest suspension system addresses the concern with customization. Most bed pillows are not adjustable, and users compensate for the lack of customization by attempting to puff up or fold the pillow, using more than one pillow to achieve the needed height, or they end up using their arms or hands to cradle their head to attain the needed support. This may compress body parts and restrict blood flow, including sensitive areas like the carotid sinus and blood vessels on the side of the neck. Customization is especially important for side-lying sleepers. A poorly fitted standard pillow may be too high or too low for a side sleeper, in turn, causing side-bending of the cervical spine where the neck muscles are overstretched on one side and shortened on the other, potentially leading to neck pain/discomfort.

Customization is also important for a leg rest: Being able to adjust leg elevation to the appropriate height and level of support can improve venous circulation. For side sleepers, keeping the upper leg supported in an anatomically neutral position takes weight off the low back and minimizes the torsional/side bending stress on the spine and other joints.

The headrest may address a potential concern relating to off gassing of volatile organic compounds (VOCs). The pliant fabric sling material, hung between the rotatable horizontal frame elements, is made of materials void of potentially toxic emissions. This is important considering the proximity of one's respiration to the pillow surface. Many of the bed pillows on the market today are made with petroleum based synthetic materials (polyester, polyurethane, and/or memory foams) which do off-gas VOCs. Additionally, some pillows (even some of the natural feather, down or cotton fill pillows) undergo chemical treatments which outgas due to its composition and/or breakdown (e.g., flame retardant, antimicrobial or pesticide treatments). Some of these chemicals are considered persistent organic pollutants and hormonal, endocrine disrupting chemicals. Regardless of marketing claims that these VOCs are at low levels, persons should not breathe in these potentially irritating/sensitizing vapors. The recommended headrest fabrics are woven using natural materials that do not off-gas VOCs.

The head/leg rest suspension system will provide a breathable rest surface, minimizing the retention of body heat. The headrest can easily be sanitized. The preferred suspension fabric is an organic cotton material that will be offered in a selection of thicknesses and stretch to accommodate user preferences. The fabric will be easily detachable for cleaning and replacement and is machine washable. It can be cleaned as simply as washing a pillowcase. This is important considering the soil and bodily secretions that accumulate on the sleep surface (e.g., saliva, sweat, dead skins cells, natural skin oils, skin products). Regular washing of the fabric minimizes concerns with allergens such as dust mites or respiratory pathogens such as mold, bacteria, and viruses. Also, there is less risk for bed bug infestation.

The suspension system frame can be easily wiped clean. Some embodiments collapse to stow away. The suspension system can be made as a sustainable product. A recyclable metal frame and biodegradable/recyclable fabric sling are recommended. The under-mattress frame insert may be a PVC-like material.

In the case of the headrest, the user has an option of resting his or her head directly on the sling platform material or adding their favorite pillow on top of the sling and adjusting the platform height to meet a desired comfort level. In the side lying position, the lower arm of the sleeper can rest freely under the headrest, and the upper arm of the sleeper may be placed on the platform facilitating chest expansion. The sling suspension system may potentially be used as a back support in the long sitting position: that is, sitting relatively upright in bed with knees straight.

In one embodiment, the present invention broadly comprises a head/leg rest suspension system, comprising a base cross support member extending the width of the bedframe with cantilevered extensions at both ends and at least one pair of oppositional frames. Each frame is comprised of an expandable vertical member extending both upwardly and downwardly from and secured to base cross support member near bedframe height, a relatively horizontal member extending cantilevered from and rotatably secured to upper-end vertical member, a rotary element overlaying and secured to upper horizontal member, a user activated rotary control element adjacent a terminal end of horizontal member, and a sling-end secured to the rotary element of each frame. Clamps or similar elements secure the expandable vertical member to the base cross support member and the base cross support member to the bedframe.

In another embodiment best suited for headboard or footboard section installations, the present invention broadly comprises a head/leg rest suspension system, comprising a pair of oppositional frames, each frame comprising a first base cross support member, a single vertical member extending upwardly from and secured to midsection of first base cross support member, a horizontal base panel or framework secured to first base cross support member, an upper horizontal member extending cantilevered from and secured to upper-end vertical member, a rotatable element overlaying and secured to upper horizontal member, a user activated rotary control element adjacent a terminal end of horizontal member, and a looped sling-end secured to the rotatable element of each frame. Clamps secure the first base cross support member to bedframe. For additional structural support, a floor base frame can be added. This floor base frame is comprised of a pair of vertical members secured to and extending downwardly from first base cross support member, and if needed, a pair of cantilevered horizontal base members secured to pair of vertical members at lower end.

In another embodiment best suited for bedside installations, the present invention broadly comprises a head/leg rest suspension system, comprising a pair of oppositional frames (for each side of the bed), each frame comprising a first base cross support member, a single vertical support member extending upwardly from midsection of first base cross support, a second base cross support member secured at midsection to upper end of vertical member, a pair of horizontal members extending cantilevered and secured to second base cross support member, a rotatable horizontal member parallel to second base cross support member and rotatably secured between the extending pair of the horizontal members, a user activated rotary control element adjacent a terminal end of upper horizontal member, clamps to secure first base cross support member to bedframe with an under mattress/box spring panel or base framework secured to first base cross support member. The base panel or framework aligns with oppositional frame panel or base framework, and a sling-end secured to the rotatable horizontal member of each frame. The cross base support frame member may also be positioned on the floor with the horizontal base supports under the bed.

In another embodiment, the present invention broadly comprises a head/leg rest suspension system, comprising a pair of oppositional frames (for each side of the bed), each comprising a first base cross support member, a pair of vertical members extending upwardly from and secured to the first base cross support member, a base panel or framework secured to first base cross support member, a pair of horizontal members extending cantilevered from and secured to the upper end vertical members, a horizontal rotatable member perpendicular to and rotatably secured between the terminal/distal ends of the cantilevered horizontal members, a user activated rotary control element adjacent a terminal end of one upper horizontal member, a second cross support member secured to upper ends of vertical members, clamps to secure first base cross support member to bedframe with under mattress/box spring panel or base framework aligned with oppositional frame panel or base framework, and a looped sling-end secured to the horizontal rotatable member of each frame. This embodiment may also include the optional floor base frame for additional frame support.

Another embodiment is designed to be attached to bedrails. This embodiment of the present invention broadly comprises a head/leg rest suspension system, comprising a pair of oppositional frames (for each bedside rail), each comprising a first base cross support member, a pair of vertical members extending upwardly from and secured to the first base cross support member, a pair of horizontal members extending cantilevered from and secured to the vertical support members, a rotatable horizontal member perpendicular to and rotatably secured between the terminal/distal ends of the cantilevered horizontal members, a user activated rotary control element adjacent a terminal end of one upper horizontal member, a second cross support member, as needed, secured to upper ends of vertical members, a pair of hooking elements (to mount bedrail) slidably secured to back end of vertical members to secure frame to top of bedrail, clamping element(s) to secure first base cross support member to lower aspect of bedrail, and a sling secured to the rotatable horizontal member of each opposing frame.

The present invention provides a device that vertically adjusts to an individual's anatomical dimensions. The vertical members of all embodiments are expandable and retractable, allowing the user to customize the height for comfort and support. The overall height of the frame can also be reduced to stow the frame away as needed. Additionally, the sling's slack, or droop, or degree of concavity is adjustable such that an individual can change the level of support during repositioning. A user actuated control element is disposed near the terminal end of the rotatable member which adjusts the concavity of the sling. This actuated control element applies to all embodiments. Also, some embodiments offer control elements to adjust the yaw or angular disposition of the fabric platform with respect to the fore-end vertical plane.

Although the invention is illustrated and described herein as embodied in a sling-like head/leg rest suspension system, it is, nevertheless, not intended to be limited to the details shown because various modifications and structural changes may be made therein without departing from the spirit of the invention and within the scope and range of equivalents of the claims. Additionally, well known elements of exemplary embodiments of the invention will not be described in detail or will be omitted so as not to obscure the relevant details of the invention.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. Defining the features of the invention that are regarded as novel will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "providing" is defined herein in its broadest sense, e.g., bringing/coming into physical existence, making available, and/or supplying to someone or something, in whole or in multiple parts at once or over a period of time.

In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes and cannot be construed as indicating or implying relative importance.

In order to describe functional aspects of the present invention, frame elements of the head/leg rest are designed to rotate or be angularly moved or positioned in three dimensions. The rotation or angular movement of various inventive components may be discussed in relationship with x, y and z coordinates forming the sling frame. The vertical z-axis lies in and is co-planar with the opposing vertical fore-frame members and, with respect to the vertical fore-frame members, an angular or rotational movement or yaw of opposing upper frame members occurs when opposing upper extension frame members or frame elements rotate with respect to the vertical z-axis plane. A lateral y-axis is defined by the laterally extending fore-frame element and, angular or rotational movement or pitch occurs when, for example, the terminal ends of opposing upper extension frames move or swing inward or towards each other, in the y direction such that the distance between the terminal ends of opposing upper frames is less than the lateral span of laterally extending fore-frame element. A longitudinal x-axis defined by opposing longitudinally extending upper frame members extending from the vertical fore-frame member plane and an angular or rotational movement or roll occurs when, for example, the terminal ends of opposing upper frames rotate about an axis defined by each individual upper frame element as shown by arrows (clockwise) and (counterclockwise).

Upper opposing horizontal frame members interlock the rotatable horizontal member which holds the slung fabric. These upper longitudinally extending frame members provide a foundation for the slung fabric which wraps around the rotatable frame member. The control mechanisms at the terminal end of the upper frame member allows both clockwise and counterclockwise rotational adjustment of the slung fabric. These rotational controls increase or decrease the slack, laxity and suspension of the bridge-like suspended slung fabric. This function, in turn, serves to increase or decrease the support height and the weight bearing surface area of support/load distribution, as well as shift the pressure point.

The upper opposing frame members may also offer a yaw or tilt function which further serves to shift the weight bearing pressure point or points established by the user's head or leg on the slung fabric. For the headrest embodiment, the angle of the sling platform can be adjusted to a relatively vertical position, approximately 90-degree rotation, to serve as a backrest. The lateral span of the upper frame members or elements may also be adjustable as described later. The longitudinal span or length of the rotary member is approximately 15 inches for the headrest and 20 to 25 inches for the leg rest suspension member. In another embodiment, the width or lateral span of these upper frame members can be adjustable as discussed later.

The pair of sling suspension frames together will function to minimize compressive forces on the user's lower facial area and neck. This is accomplished by angle adjustment of the sling support members at the sling's fore-end medially and inferiorly a few degrees. This serves to decrease slung fabric tension, that is, to increase laxity at the anterior edge of the sling platform where the lower head/face are supported. Similarly for the leg rest application, decreasing fabric platform tension along the edge of the knee side is important.

The suspension fabric may be a material with resilient stretch that is attached via fasteners, loops or channels and suspended between both oppositional frames' rotatable frame element. The width of the sling, from right end to left end, will vary depending on the span between right and left suspension frames; but the fabric will need to accommodate, at a minimum, the distance between both frames and ideally provide additional fabric to increase its slack or droop. It is contemplated, in one headrest embodiment, that the slung fabric's depth will be approximately 13 inches: this is the surface area that covers the top of the head to the bottom of the head.

It is contemplated, in one headrest embodiment, that the slung fabric's depth will be approximately 13 inches: this is the surface area that covers the top of the head to the bottom of the head.

The recommended span between suspension frames is a minimum of 24 inches (two feet) and a maximum of 30 inches. A twin sized bed would accommodate one set (paired) frames. Wider beds such as Full, Queen or King sizes would require an additional set of frames or a central frame support system.

In some embodiments, frame system may include lower base members extending longitudinally from the lower terminal ends of the opposing vertical fore-end frame elements. This base frame system can be placed on the floor or can be placed between the mattress and the mattress frame, bedframe platform, box spring or any other type of platform which supports the mattress, to secure the sling system on the bedframe. In one embodiment, these base frame elements may be made of some type of plastic or PVC-type material. The base frame system may include one, two or more cross bar members to increase the stability when the entire framework is installed with the base framework interposed between the mattress and the bedframe platform. In some situations, the base framework may be placed on the floor beneath the bed with the addition of extendable opposing vertical fore-end frame members.

Most embodiments offer a stowage position enabled by the collapse the vertical frame members onto themselves, which thereby reduces the vertical span in the z direction to substantially match the height of the mattress, or, for storage, to collapse the vertical frame to its minimum telescopic condition.

Typically, the weight of an adult user's head is about 8-12 pounds. However, the sling frame may account for the weight of a user's arm and the nominal weight of the pillow. The vertical height of a user's head is about 10 inches and the lateral span of a typical adult user head is about 6.5 inches. A typical broad-shouldered adult has about a 20-inch lateral shoulder span than from left to right shoulder joint. The suspension system for leg-rest use will accommodate greater weight loads.

BRIEF DESCRIPTION OF THE DRAWINGS

Further objects and advantages of the present invention can be found in the detailed description of the invention. Various embodiments are disclosed, by way of example only, with reference to the accompanying schematic drawings in which corresponding reference symbols indicate corresponding parts.

DETAILED DESCRIPTION

At the outset, it should be appreciated that like drawing numbers on different drawing views identify identical, or functionally similar, structural elements. It is to be understood that the claims are not limited to the disclosed aspects. Furthermore, it is understood that this disclosure is not limited to the particular methodology, materials and modifications described and as such may, of course, vary. It is also understood that the terminology used herein is for the purpose of describing particular aspects only and is not intended to limit the scope of the claims. Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

Figure 1A:
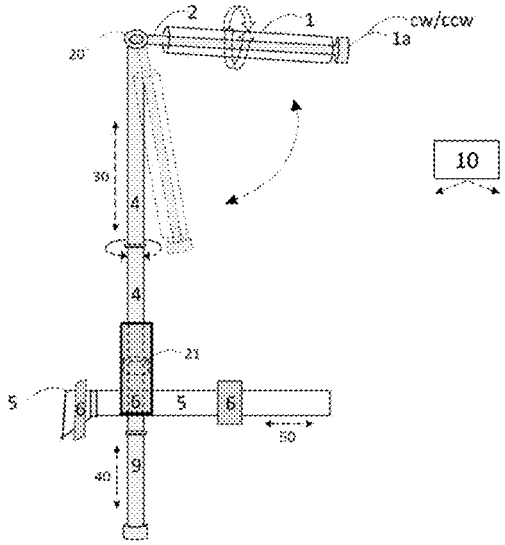
FIG. 1A shows a perspective view of an embodiment of the present invention.

FIG. 1A is a perspective view of a first embodiment of the present invention. Headrest suspension system 13, FIG. 1C, generally comprises the essential components of a pair of frames, that is, a right and left side frame, and a sling or bridge or suspended fabric 8. The suspended fabric is designed to be attached, via looped ends for example, to the pair of oppositional frames, spanning across the right and left side frame. Sling 8 is arranged to provide a support for an individual's head when they are laying down, either on their back, sides, or stomach. Sling 8 is a fabric or other pliant material that does not release volatile organic compounds (VOCs). Preferably, sling 8 or slung fabric 8 forms a relatively flat or concave head support platform for the user's head.

Framework 10 in FIGS. 1A/B includes a longitudinally extending, generally horizontal, member 2 which may be a tube, solid rods, or any other suitable member. Horizontal member 2 supports the overlaying rotary frame element 1 or it alone may serve as the rotatable member which holds one end of the sling fabric. Frame member 2 has two ends: the distal end having a user control end cap 1*a*, and the opposite proximal/fore end engaging a rotatable connector 20 and extending cantilevered from connector 20. Rotatable control connector 20 connects upper horizontal frame member 2 to the upper terminal end of vertical frame member 4. It should be appreciated that rotatable control connector 20 may be a rotatable universal joint connector that allows movement in the x, y, or z axes. Rotatable control connector 20 may also be a hinged connector that allows movement in only one plane. If control connector 20 is a hinged connector, the pitch of the upper longitudinal frame member 2 can be moved 90° to be near or in the fore-end vertical plane defined by opposing vertical frame member 4 or allow the arm of frame member 2 to rotate to a vertical position above vertical frame member 4.

Vertical frame member 4 may be a tube, solid rods, or any other suitable member. Vertical member 4 is expandable and retractable or telescoping to permit vertical adjustment 30 to configure framework 10 to an appropriate user height under the control of the user. The shaft of vertical frame member 4 may also offer a pivot function allowing it to turn on its axis rotating at least 180 degrees to allow the horizontal frame member 2 to turn medially or laterally 90 degrees. Vertical frame member 4 is slidably secured at its lower end to the base cross support frame member 5 via sliding control clamp(s) 21 and extends beyond the base cross support member 5 down to the floor as vertical member 9 in FIG. 1A.

Clamp 21 may be a ring clamp, or any other suitable connector that permits horizontal adjustment 50 along the length of cross support member 5. Clamps 6 secure the base cross support frame member 5 to the bedframe or the base cross support member 5 can be adapted as a free-standing frame to be secured to the bedframe (not shown).

Figure 1B:
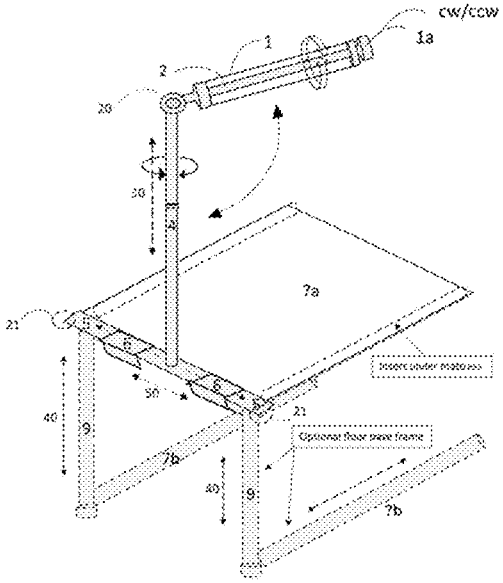
FIG. 1B shows a perspective view of another embodiment of the present invention.
Figure 1C:
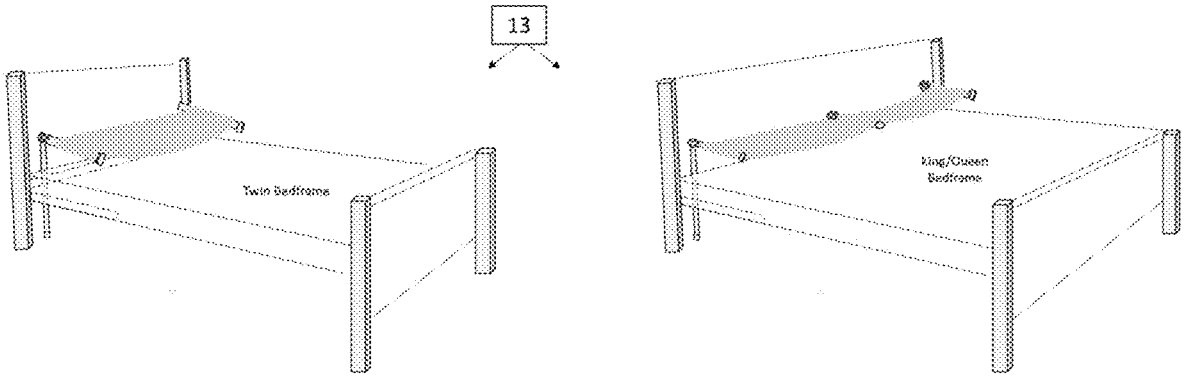
FIG. 1C shows a perspective view of FIG. 1A embodiment of the present invention in a functional set up.

The embodiment in FIG. 1B offers similar features to FIG. 1A. FIG. 1B adds additional framing members to be assessed that accommodate a variety of installation needs. Upper horizontal member 2 and any attachments are the same as in FIG. 1A described above. And connecting element 20 is also described in 1A. In this embodiment, a lower horizontal base panel or framework is added to support the entire framework 10. Vertical member 4 is connected at the upper end to connecting element 20 which may be a hinge or universal joint. Vertical member 4 is expandable and retractable or telescoping and may also pivot. The lower end of vertical member 4 is secured to midsection of base cross support member 5. A base panel or framework 7*a* is secured to base cross support member 5 which is meant to be inserted between the mattress and bed platform or box spring and bed platform to support the suspension frame 10. The base panel 7*a* may be rotatably secured to frame member 5 via a ring clamp. Base cross support member 5 may be expandable and secured to the bedframe with clamps 6.

An added adaptation to the embodiment in FIG. 1B is a lower frame support. A pair of vertical members 9, 9 are secured to and extending downwardly from base cross support member 5. Frame members 9, 9 may be any suitable member that is expandable or telescoping for height adjustment to align the base cross support member to be colinear with the needed mattress/box spring/bedframe height level. A securing element is used to secure the pair of vertical members 9, 9 to the bedframe if the base cross support member 5 cannot be secured to the bedframe. Optionally, a pair of lower horizontal floor base members extending longitudinally from and secured to the lower terminal end of vertical members 9, 9.

Figure 2A:
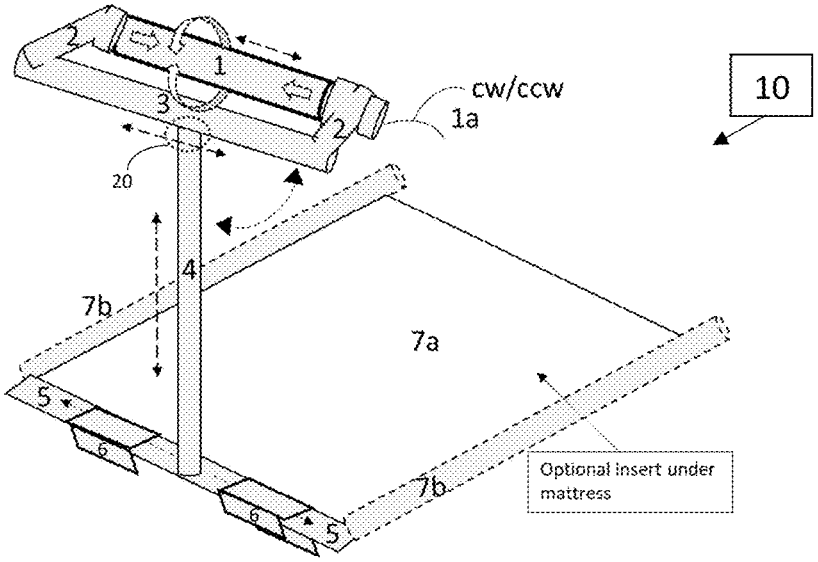
FIG. 2A shows a perspective view of an embodiment of the present invention for bedside installations.
Figure 2B:
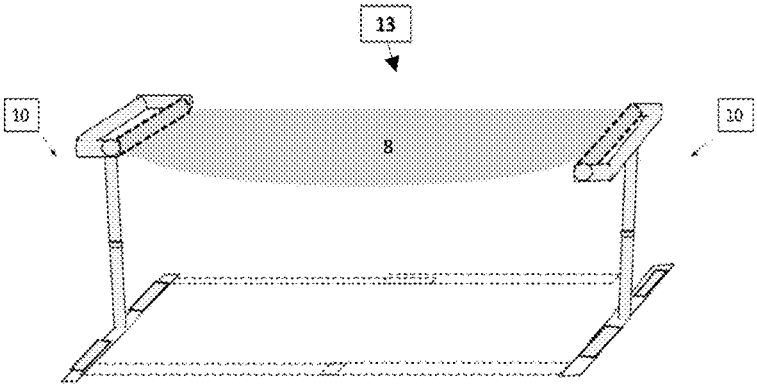
FIG. 2B shows a perspective view of FIG. 2A embodiment of the present invention functionally paired.
Figure 2C:
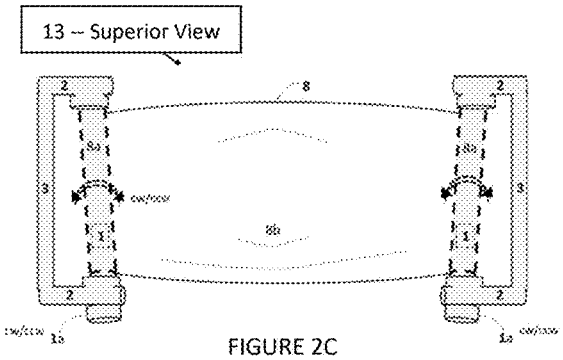
FIG. 2C shows a superior view of FIG. 2B embodiment of the present invention.
Figure 2D:
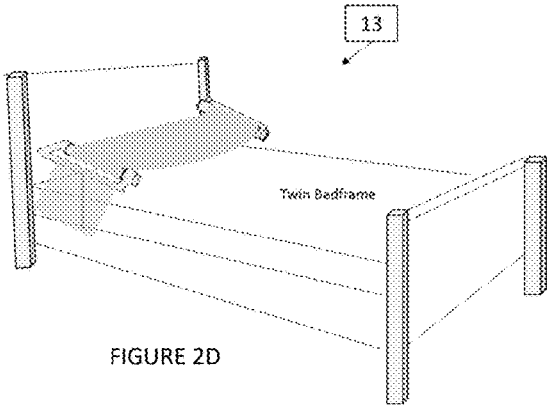
FIG. 2D shows a perspective view of FIG. 2A embodiment of the present invention in a functional set up.

The frame 10 in FIG. 2A is an embodiment of the present invention for bedside installations. This embodiment includes some of the above-mentioned features. This bedside embodiment's rotatable frame member 1 may be a tube, a solid rod or any suitable member which holds one end of the sling fabric. Rotatable member 1 is supported at both terminal ends by a coupling and is rotatably secured between horizontal members 2, 2. Several release mechanisms to allow for the removal or replacement of the suspended fabric are considered. One is a spring function which allows the frame member 1 to expand and retract to shorten the longitudinal aspect to attach or disengage from supporting horizontal frame members 2, 2. Another option might be that one of the couplings can open on the top side, for example, to allow rotatable member 1 to be lift up and out. Rotatable Frame member 1 may be a tube, a solid rod or any suitable member which holds one end of the sling fabric. The pair of horizontal frame members 2, 2 extend cantilevered from and secured to the upper base cross support member 3. These horizontal supporting members 2,2 may be of unequal lengths to decrease sling fabric tension on the edge which supports the user's lower face and neck—or in the case of a leg rest, the edge of the fabric that is closest to the knee.

Upper base cross support member 3 as well as rotatable member 1 may have expandable components with the appropriate locking mechanisms to adjust for differing depth requirements when the frame is used for a leg rest versus a head rest.

The upper base cross support member 3 is rotatably secured to the upper terminal end of vertical member 4 via rotatable control connector 20. This connector 20 may be a hinge joint or other suitable connector which allows sling platform to be tilted slightly or to bring the upper base cross support member 3 in a relatively vertical position. Vertical member 4 in FIG. 2A will be expandable and retractable for user height adjustment and to stow. Vertical member 4 may also include a pivot function.

The lower end of vertical member 4 in FIG. 2A is secured to midsection of base cross support member 5. A base panel 7*a* or framework 7*b* is secured to base cross support member 5 which is meant to be inserted between the mattress and bed platform or box spring and bed platform. The base panel 7*a* may be rotatably secured to frame member 5 via a ring clamp. Base cross support member 5, which may be expandable, is secured to the bedframe with clamps 6 or adapted to be positioned on the floor under the bed.

An added adaptation to the embodiment in FIG. 2A is a lower frame support. A pair of vertical members 9, 9 are secured to and extending downwardly from base cross support member 5. Frame members 9, 9 may be any suitable member that is expandable or telescoping for height adjustment to align the lower base cross support member 5 to be colinear with the needed mattress/box spring/bedframe height level. A clamp or securing element is used to secure the pair of vertical members 9, 9 to the bedframe if the lower base cross support member 5 cannot be secured to the bedframe. Optionally, a pair of lower horizontal floor base members extend longitudinally, cantilevered from and secured to the lower terminal end of vertical members 9, 9.

Figure 3A:
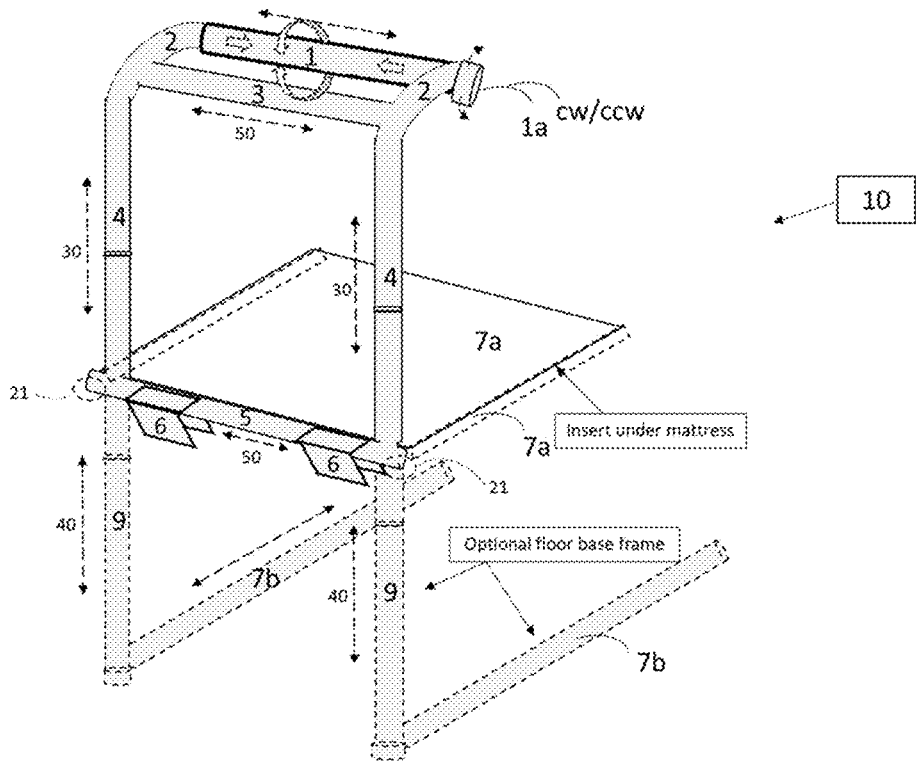
FIG. 3A shows another perspective view of an embodiment of the present invention for bedside installations.
Figure 3B:
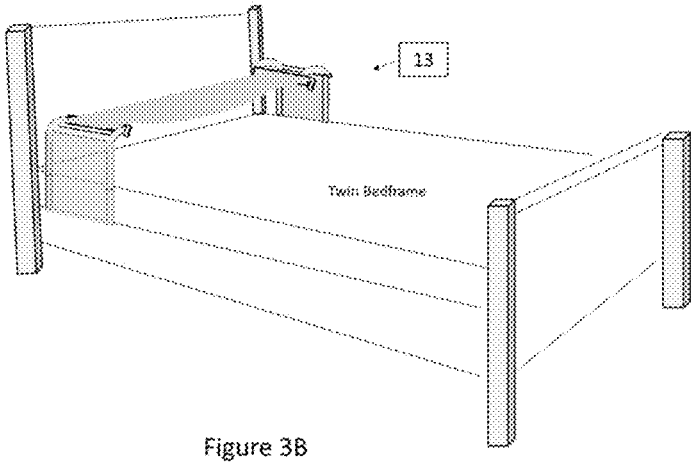
FIG. 3B shows a perspective view of FIG. 3A embodiment of the present invention in a functional set up.

FIG. 3A reflects another embodiment for bedside installations. Many of the characteristics in this embodiment are like those of 2A. The rotatable member 1 which holds the looped end of the sling fabric (a tube, solid rod or other suitable member) is supported at both terminal ends by a coupling and is rotatably secured between horizontal members 2, 2. Several release mechanisms to install or disengage rotatable member 1, as previously described, will be assessed. The pair of horizontal frame members 2, 2 extend cantilevered from and are secured to upper terminal ends of the pair of vertical members 4, 4; however, horizontal members 2, 2 may extend cantilevered with differing lengths. The upper cross support 3 is secured to the pair of vertical supports 4, 4 near where it intersects with horizontal frame members 2, 2, and the control element to bilaterally lower or lift the expandable and/or telescoping vertical members 4, 4 will be located upper side, midsection of cross support member 3. The lower terminal ends of 4, 4 are secured to lower base cross support member 5. A base panel or framework 7*a* is secured to base cross support member 5 which is meant to be inserted between the mattress and bed platform or box spring and bed platform. The base panel 7*a* may be rotatably secured to frame member 5 via a ring clamp. Base cross support member 5 is secured to the bedframe with clamps 6. FIG. 3A may also be adapted with a lower frame support where a pair of vertical members 9, 9 are secured to and extending downwardly from base cross support member 5. Frame members 9, 9 may be any suitable member that is expandable or telescoping for height adjustment to align the lower base cross support member 5 to be colinear with the needed mattress/box spring/bedframe height level. A clamp or securing element is used to secure the pair of vertical members 9, 9 to the bedframe if the lower base cross support member 5 cannot be secured to the bedframe. A pair of lower horizontal floor base members may be added which extend longitudinally, cantilevered from and secured to the lower terminal ends of vertical members 9, 9.

Figure 4:
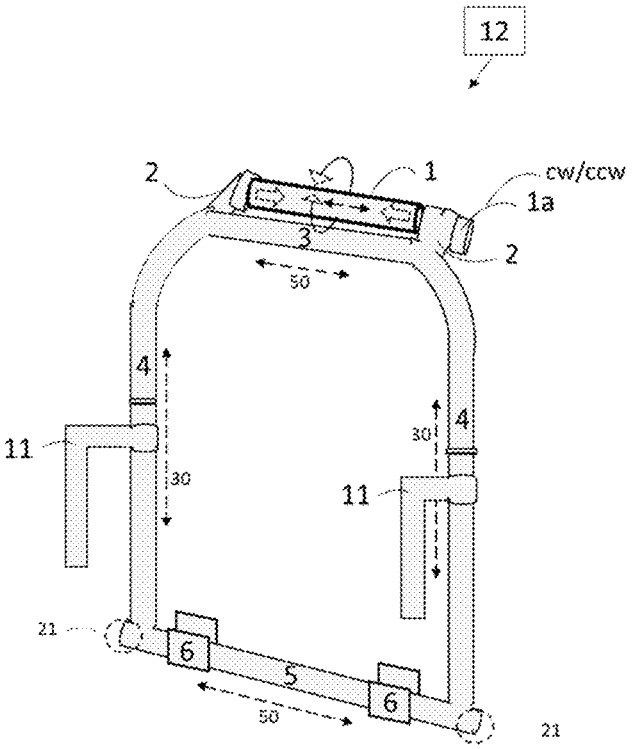
FIG. 4 shows a perspective view of another embodiment of the present invention for bedrail installations.

In FIG. 4, this embodiment of the present invention is suited for bedrail installations. Similarly, the rotatable member 1 is supported at both terminal ends by a coupling and is rotatably secured between horizontal members 2, 2. Rotatable Frame member 1 may be a tube, a solid rod or any suitable member which holds the looped end of the sling fabric. The pair of horizontal frame members 2, 2 extend cantilevered from and secured to the upper base cross support member 3. These horizontal supporting members 2, 2 may be of unequal lengths to decrease sling fabric tension on the edge which supports the user's lower face and neck—or in the case of a leg rest, the edge of the fabric that is closest to the knee. The upper terminal ends of vertical members 4, 4 are secured to the upper base cross support member 3 and the lower terminal ends are secured to the lower base cross support member 5. Vertical members 4, 4 are expandable or telescoping. A pair of hooking elements 11 for mounting frame assembly 12 onto bedrail is slidably secured to each vertical member 4, 4. Clamps 6, 6 are used to secure the lower base cross support member to the lower part of the bedrail.

Sling or bridge fabric 8 is arranged to allow a user's head to rest on the sling fabric platform. Sling fabric 8 may include loops or channels 8*a* arranged at opposite ends of sling 8. Loops or channels 8*a* are arranged to accept longitudinally extending rotatable members 1, 1, or in FIG. 1A/1B embodiments, potentially 2, 2. The configurations of attaching sling 8 to the suspension system's rotatable member may also be accomplished by a plurality of fasteners, snaps, Velcro or other removable attachment means to allow sling 8 to be removed for cleaning or replacement. When sling fabric 8 is attached to rotatable upper frame members, it creates a suspended fabric platform which may be substantially flat or having a substantially centered depression or droop/concavity 8*b*. The headrest suspension system 13 is a bed pillow alternative that can be set up to support a user's head. Similarly, the sling or bridge fabric can be used to support the user's lower extremities when appropriately sized and installed on the foot-side of the bed. When the user's head is on the fabric and in operational use, some concavity will be established. The laxity or degree of concave sling depression 8*b* of sling fabric 8 may be increased or decreased in depth by the adjustment of control elements 1*a*.

Controllable element 1*a* enables the user to adjust the tension and hence the depth or concave size of the resilient sling fabric or material 8 (otherwise referred to as the laxity of the fabric) by either rotating the control in a clockwise or counterclockwise direction (cw/ccw). The effect is to either tighten or reduce the concave condition of the sling fabric or to move the control to loosen or increase the concavity of the sling fabric. The assigned direction of the control element 1*a* will vary depending on whether the attached sling is initially rolled over or under the top of the rotatable member. In other words, a clockwise or counterclockwise may cause the same effect depending on if the rotation was initiated with an over-hang or underhung relative to the rotatable member. The control knob has a roll control (rotating about the axis formed by a single frame element) which may be a single or multiple gear teeth which co-acts with defined positional internal slots in the terminal end of the frame member 1 or 2. This roll function, in turn, serves to increase or decrease the weight bearing surface area of support, that is, the load distribution on the sling.

In addition to the rotatable tension, roll control for the fabric sling, another control element offers a yaw or tilt function which further serves to shift the weight bearing pressure point established by the user's head on the slung fabric.

The lateral span of the upper frame members or elements may also be adjustable. Each cross-member frame element 3, 5 may have control elements to telescopically collapse or expand the lateral span of the system. One type of control element is a spring-loaded button lock which, when the button is placed in laterally displaced holes, the telescopically configured frame elements 3, 5 enable the user to select the proper lateral span of the system. The user presses the button down, releasing the spring-loaded button from the first hole, then moves the telescopic tubes relative to each other such that the button snaps into the next selected positional hole. Other telescopic, releasable and locking systems can be used such a cam-driven twist close, twist open lock. Another vertical adjustment controls could be spring-loaded laterally outboard facing control rods. The laterally outboard ends of these control rods fit into vertical position-defining apertures in the vertical frame(s) 4, which define the vertical positions of frame element 4.

In one further enhancement of the present invention, there is a control or adjustment system which permits vertical frame element(s) 4, 9 to be adjusted to a comfortable vertical height selected by the user or to reduce the overall vertical height of the sling frame and further permitting the user to remove the sling frame from the bed and stow the frame away as needed. These vertical control elements may be spring-loaded button locks, twist lock-unlock cam operated controls, or biased outboard actuated control rods similar to that discussed above in connection with the vertical adjustment mechanisms of vertical frame(s) 4.

In a further embodiment not shown in the drawings, the frame suspension system 10 in FIGS. 1A and 1B may be adapted to serve as a frame support for two sling platforms centrally without rotational capacity. Each individual sling platform would then have only one control 1*a* to adjust their sling platform's tension or concavity.

In a further modification, the fore-end vertical frame member(s) 4 need not be straight nor disposed in a singular vertical plane. In other words, the vertical frame elements may generally be in a single plane.

In a further embodiment of the present invention, the frame system may include one or more fore-end cross members laterally spanning distance y and being connected to opposing vertical fore-end frame members 4, 4. These cross members may include lateral control elements as described above.

As discussed above, the upper longitudinal frame members 2, 2 may, upon activation of a control elements, rotate about 90° to change the pitch to fully collapse the entire framework. In this mode, these upper frame members are placed substantially in a vertical plane formed by opposing vertical frame members 4, 4.

Another possible stow-away position is enabled by the telescopic collapse of vertical frame member(s) 4 onto themselves as discussed above. This reduces the vertical span in the z direction to substantially match the height of the mattress and in some cases to collapse the entire system upon itself and into a generally single storage plane, limited only by the telescopic closeable limits of the vertical framework.

What I claim is:

1. A recumbent sling headrest suspension system configured as a sleep pillow alternative, comprising:

a frame comprising:

a base cross support frame member;

a first pair of horizontal base members extending laterally from opposing ends of the base cross support frame member;

a vertical support frame member extending upwardly from a midpoint of the base cross support frame member;

an upper cross support frame member secured to an upper end of the vertical support frame member;

a second pair of short horizontal frame members extending cantilevered from opposite ends of the upper cross support frame member;

a sling-support frame member rotatably secured between distal ends of the second pair of short horizontal frame members, aligned generally parallel to the upper cross support frame member;

a sling of pliant fabric secured bilaterally to the sling-support frame member; and one or more user-actuated control elements operable to adjust:

i. a tension, laxity or droop of the sling fabric;

ii. a tilt of the upper cross support frame member; and iii. a height of the vertical support frame member.

2. The system of claim 1, wherein the sling-support frame member is rotatable to allow adjustment of the tension, laxity or droop of the pliant fabric of the sling during use to alter surface support for user comfort and is further configured to be removable and replaceable to facilitate sling attachment.

3. The system of claim 1, wherein a sling fabric extends beyond a span of the sling-support frame members to allow slack for rotational adjustment of droop height to reach a sleep surface level.

4. The system of claim 1, wherein the vertical support frame member is height-adjustable to raise or lower the sling-support frame member for user comfort.

5. The system of claim 1, wherein the base cross support frame member and the pair of horizontal base members are positionable either (i) between a mattress and a box-spring or bed platform, or (ii) on a floor beneath a bed.

* * * * *